US005155310A

United States Patent [19]

Goans

[11] Patent Number: 5,155,310

[45] Date of Patent: Oct. 13, 1992

[54] PRESSURE SWITCH ASSEMBLY

[76] Inventor: Kip B. Goans, 2576 Apollo Ave., Harvey, La. 70058

[21] Appl. No.: 644,193

[22] Filed: Jan. 22, 1991

[51] Int. Cl.[5] ..... H01H 35/38

[52] U.S. Cl. ..... 200/82 R; 260/82 C

[58] Field of Search ..... 200/82 R, 82 C, 82 D

[56] References Cited

U.S. PATENT DOCUMENTS

| | | | |
|---|---|---|---|
| 2,803,718 | 8/1957 | Bloom et al. | 200/82 C |
| 3,606,487 | 9/1971 | Kersting | 200/82 D |
| 3,608,977 | 9/1971 | Kersting | 200/82 D X |
| 3,737,603 | 6/1973 | Kish et al. | 200/82 D |

*Primary Examiner*—J. R. Scott

*Attorney, Agent, or Firm*—Jackson & Walker

[57] ABSTRACT

The present invention provides a pressure switch assembly for monitoring a source of fluid pressure. In one embodiment, the pressure switch assembly senses a variation of fluid pressure for actuation of a micro-switch to open or close an electric circuit. In another embodiment, the pressure switch assembly provides a self contained cluster of piston members which are selectively interengagable to permit a variety of predetermined pressure ratings to act on the pressure switch assembly in response to a fluid pressure source, the cluster being manually reorganizable without adding or removing any parts to provide one valve assembly which may be responsive to a number of pre-selectable pressure ratings.

20 Claims, 3 Drawing Sheets

PRESSURE SWITCH ASSEMBLY

BACKGROUND OF THE INVENTION (1) Field of the Invention

The invention relates to a pressure switch for sensing a control fluid pressure in response to variations of a monitored fluid pressure either above or below a desired normal value.

(2) Brief Description of the Prior Art

Pressure switches for sensing a control fluid pressure and for shifting a valve element in response thereto have been widely employed in the prior art. In many instances, the prior art has involved incorporation of a "spool" assembly which is manipulatable between positions in response to a pre-determined fluid pressure either of a liquid or a gas for shifting across a port or a passage to detect a pre-determined level in the sourced fluid pressure, or, alternatively, to actuate another mechanism.

In some instances, it may be desirable to sense a pre-determined level of a source of fluid pressure, and either provide an electronic indication of such sensed level or, alternatively, to activate an electronic signal for actuating an auxiliary mechanism by electric means, including a micro-switch or a fiber-optic-actuated mechanism which is, in turn, actuated by such microswitch.

In many instances, it would be desirable to provide a single pressure switch assembly which may be responsive to a number of pre-selected levels of fluid pressure in the source or fluid conduit. In the past, any such pressure switch assembly would have to be enlarged, considerably, to incorporate a complex valving system which could be manipulated to provide one of several fluid levels for actuation. Such construction is cumbersome and expensive.

The present invention addresses the problems set forth above and provides a remedy therefore.

SUMMARY OF THE INVENTION

The present invention provides two unique features of a pressure switch assembly. In a preferred embodiment, these two features are combined into one assembly.

In one embodiment, a pressure switch is provided which is actuatable by a monitored fluid pressure. The pressure switch comprises a body having a central cylindrical chamber. A reduced diameter bore communicates with one end of the central chamber, and a spool is disposed in the reduced diameter bore. A bore is defined in the pressure switch transverse of the spool and communicates with the reduced diameter bore for receipt therethrough of a rod actuator. The rod actuator, in turn, has a profiled inner tip extending interiorly of the reduced diameter bore, and an outer tip for contact with a micro-switch to selectively open and close an electronic signal circuit in response to a sensed pressure level in the pressure switch. A mating surface is disposed on the spool and is companionly contoured relative to the profiled inner tip of the actuator rod.

First means are provided in the central cylindrical chamber for applying a bias against one end of the spool valve equal to a pre-determined pressure level sensed by the pressure switch. A second means in the body is in communication with the source of fluid pressure for overcoming the bias of the first means in response to a pressure level detected by the pressure switch in variation of the pre-determined fluid pressure level to manipulate the spool in a first direction and shift the rod actuator to one position to either open or close the circuit.

In another embodiment, the pressure switch comprises a body with a cylindrical chamber together with a reduced diameter bore communicating with one end of the chamber. A spool is disposed in the reduced diameter bore with first means in the central cylindrical chamber for applying a bias against the first end of the spool equal to a pre-determined pressure level sensed by the pressure switch. A piston chamber is disposed in the body in communication with the reduced diameter bore, with a cluster of piston members for shifting of the pressure switch in a first direction, with each member defining a face having a separate effective piston area thereacross corresponding to a respective pre-determined pressure rating of the monitored fluid and selectively arrangable within the body to permit only one of the pre-determined pressure ratings of the monitored fluid to act on the cluster and shift the spool in a first direction.

DESCRIPTION OF THE PREFERRED EMBODIMENTS

Figure 1:
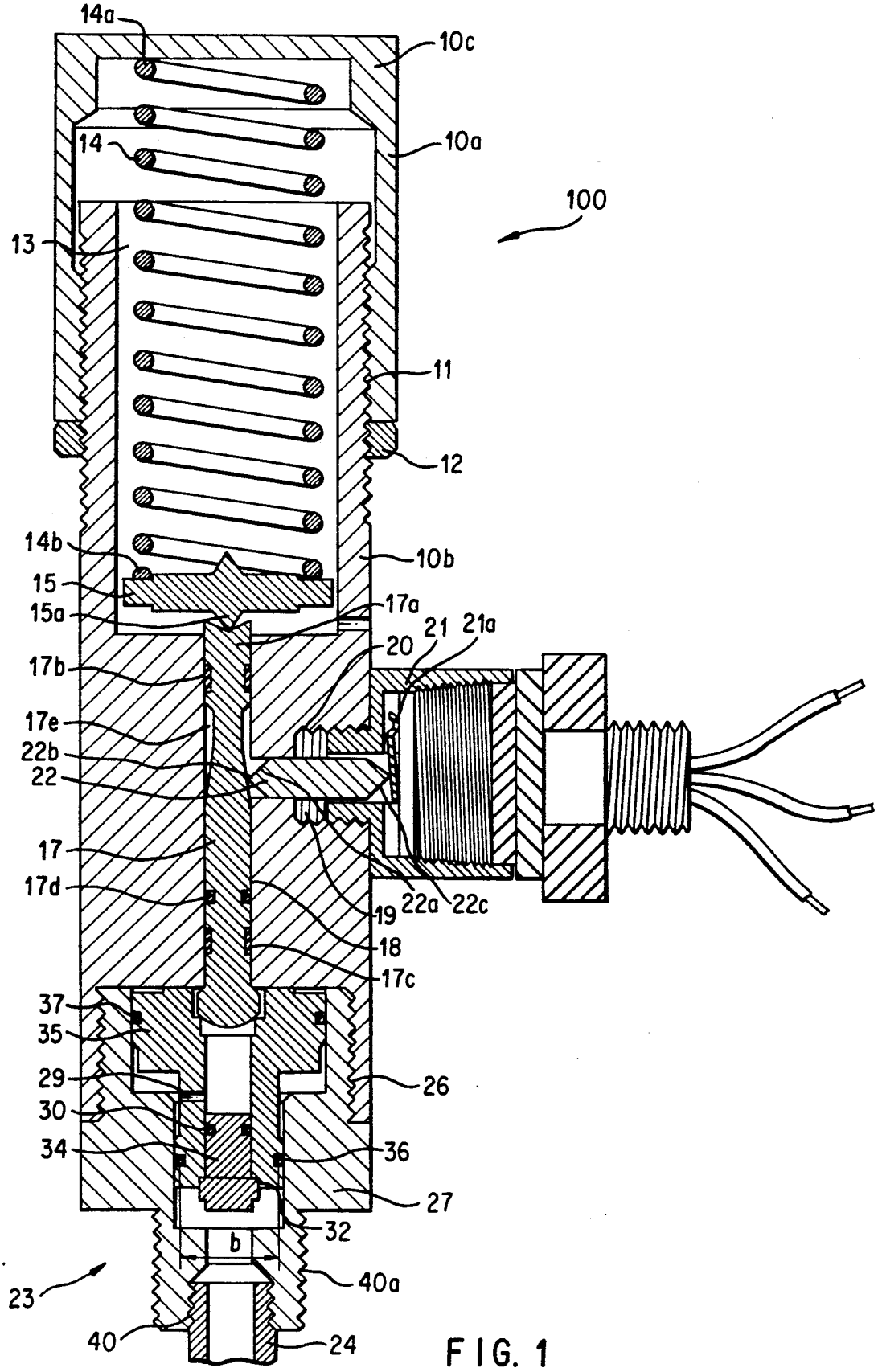
FIG. 1 is a longitudinal sectional view of the apparatus of the present invention with the micro-switch being shown closed with the monitored fluid pressure acting on the intermediate piston member.

Now, with reference to FIG. 1, there is shown a pressure switch assembly 100 having a body comprised of an upper cap 10*a* secured at threads 11 to an inner member 10*b*. A lock ring 12 is secured around the threads 11 to permit engagement of the body top 10*a* relative to the inner member 10*b* in a locked position. As will be appreciated, the length of the threads 11 on the body 10*b* are configured such that the top 10*a* may telescope relative to the inner member 10*b* along the threads 11 prior to insertion of the lock ring 12 to accommodate various sizes of a biasing member, such as spring 14 which is housed within the central cylindrical chamber 13 defined within the body member 10*b*.

The biasing member 14 has its upper end 14*a* snugly secured against the innermost end of the cap 10*a* with the lower end 14*b* of the spring 14 seating upon the upper face of a spring retainer 15. The retainer 15 has a lower facing centered retainer point 15*a* which is matingly received within a retainer point groove 17*a* at the uppermost end of a spool 17. The spool 17 is elongated and is housed within a reduced diameter bore 18 in the inner member 10*b*. An upper elastomeric wear bearing 17*b* is circumferentially carried within a companion grooveway in the spool valve 17, while a similar lower Wear bearing 17*c* is disposed around the lowermost end of the spool 17. An o-ring 17*d* is carried within a companion grooveway around the spool 17 intermediate the wear bearing 17*b*, 17*c* to prevent fluid communication thereacross.

The spool 17 also provides a profiled mating surface 17*e* just below the lower end of the upper bearing 17*b* for interengagement with the inner tip 22*b* of a rod actuator 22 received transversely of the spool 17 within a rod actuator bore 19. The bore 19 has threads 20 for receipt of the micro-switch housing 21. A profile 22*a* is defined on the rod actuator 22 and which forms the inner tip thereof. A similarly conformed outer tip 22*c* is defined on the outboard-most end of the rod actuator 22 and extends to a bias contact 21*a* on the micro-switch 21.

The lowermost end of the switch assembly 100 contains pilot cluster housing 27 secured to the inner member 10*b* by means of threads 26. The cluster housing 27 houses the second means in the body 23 and receives monitored fluid pressure conduit 24 secured to the housing 27 at its outboard end by means of threads 40. Alternatively, threads 40*a* may secure the pilot 100 directly to a source of monitored fluid pressure, in which instance a conduit 24 would not be secured to the threads 40.

Figure 2:
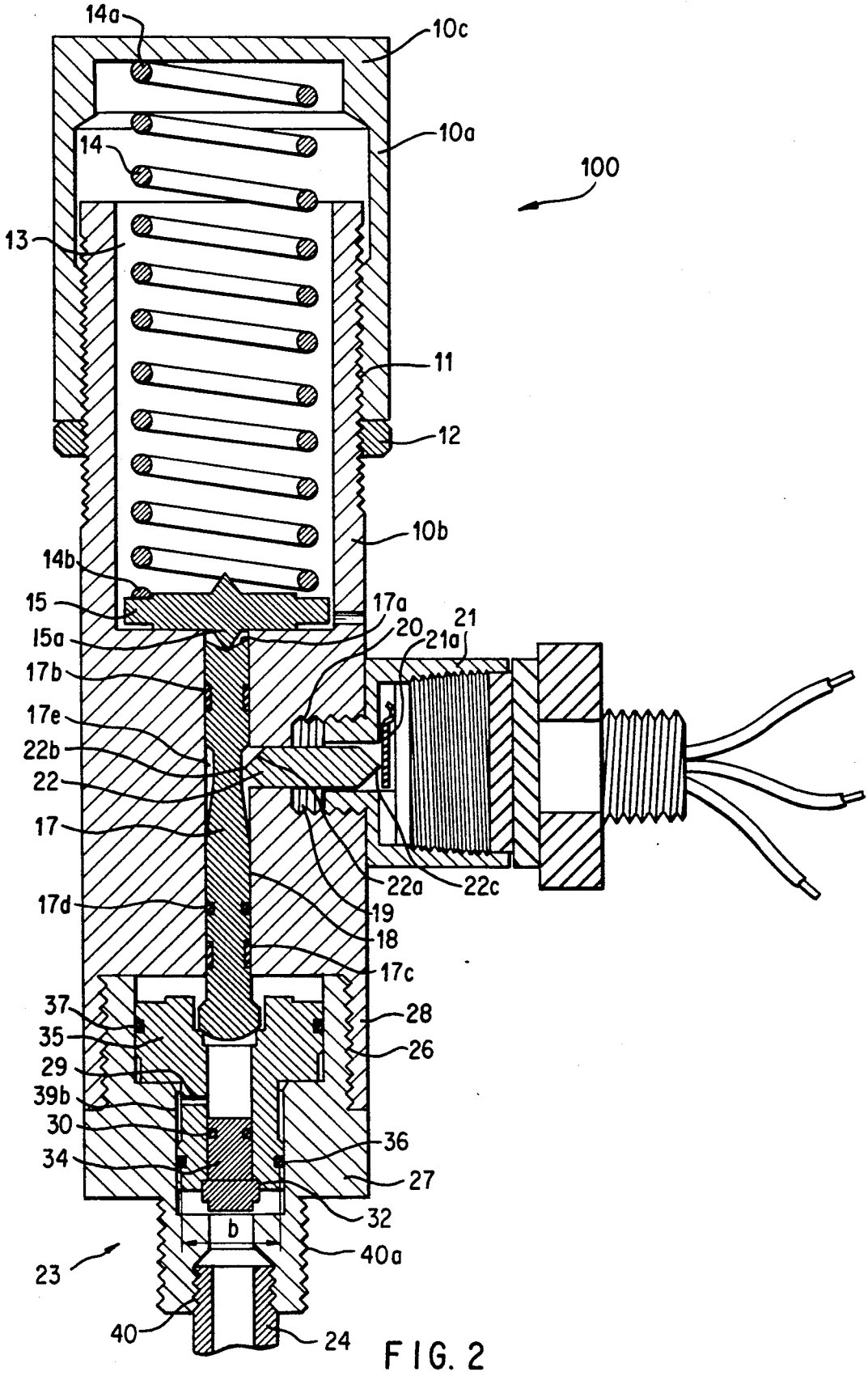
FIG. 2 is a view similar to that of FIG. 1 but illustrating the pressure switch assembly in position with the micro-switch open.

As shown in FIGS. 1 and 2, the second means in the body 23, or cluster 23, is shown such that the cluster provides actuation in response to an intermediate effective piston area "b".

Figure 3:
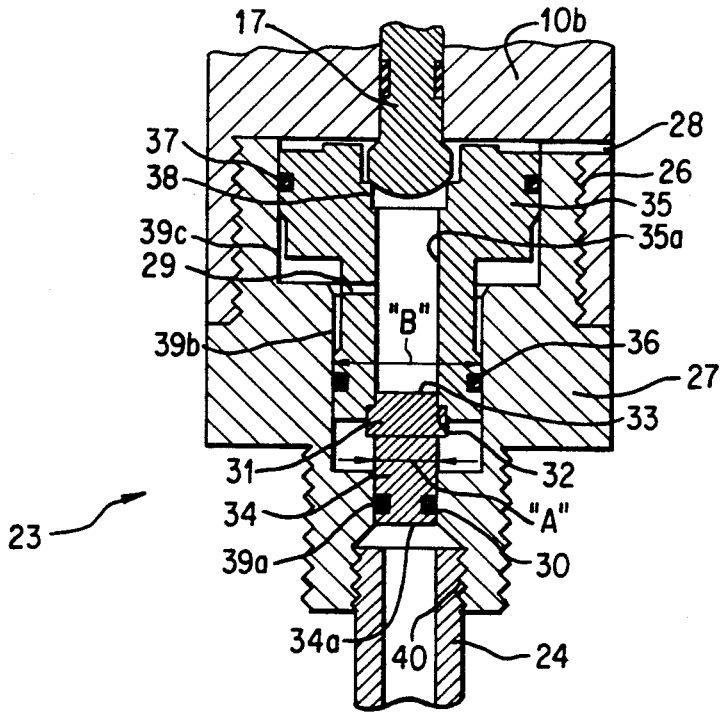
FIG. 3 is a view similar to that of FIGS. 1 and 2, but showing the detail portion of the apparatus which includes the smaller of the members of the piston cluster positioned in the cluster such that the fluid pressure acts on the smaller member.

Now looking at FIG. 3, the piston cluster is shown with the cluster housing 27 secured at threads 26. Vent 28 is disposed within the inner member 10*b* to permit venting of pressure as the piston cluster is moved inboardly.

The cluster housing 27 provides a series of sized cylinder bores 39*a*, 39*b* and 39*c*. Assuming that a cluster of piston members is to be adapted for use within the pressure switch assembly 100 such that one of three different, pre-determined pressure ratings may be utilized to actuate the pressure switch assembly 100, i.e., low, intermediate and high pressure ratings, the cluster shown in FIG. 3, and so arranged, will be provided. In such instances, the cluster will consist of the first cluster member 34 arranged relative to the second cluster member 35 as shown in FIG. 3.

A slot 32 is defined at the lowermost end around the second cluster member 35 for receipt of a companion "t" member 31 at the uppermost end of the first cluster member 34, with the first cluster member 34 providing a circumferentially extending elastomeric o-ring seal element 30 at its outboard end 34 for receipt within the cylinder bore 39*a*.

The interengagement of the first cluster member 34 with the second cluster member 35 by means of the "t" member 31 within the slot 32 will carry the second cluster member 35 within the housing 27, as shown.

Interengagement between the spool 17 and the uppermost end of the second cluster member 35 will cause the spool 17 to move in response to detection of pressure across an effective piston area "a" defined across the o-ring 30 of the first cluster member 34, in the position as shown.

Figure 4:
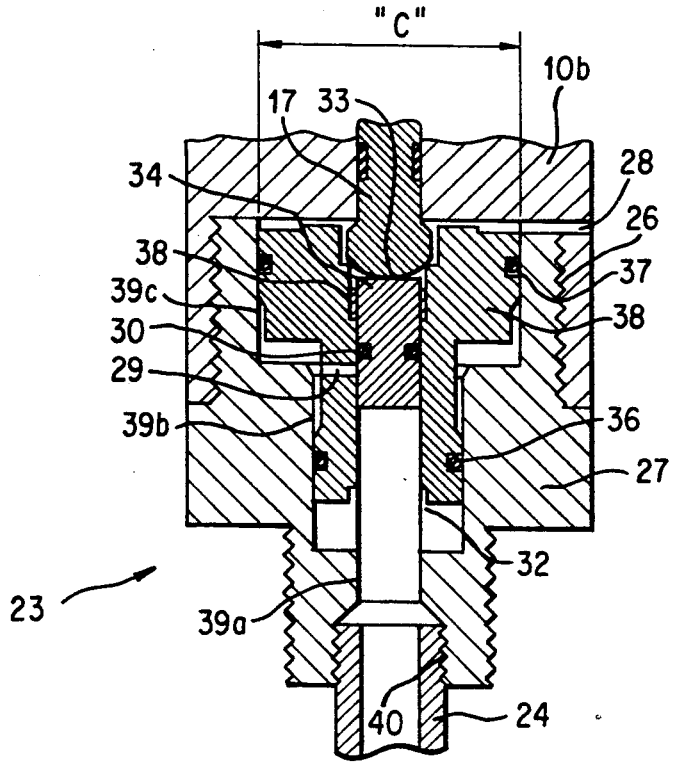
FIG. 4 is a view similar to that of FIG. 3 showing the larger of the members of the piston cluster being positioned within the apparatus such that the monitored fluid pressure acts on the larger piston area.

If the lower pre-determined pressure rating of the monitored source of fluid is to cause movement and activation of the spool 17, the cluster members 34 and 35 are arranged in the cluster housing 27, as in FIG. 4, such that the cluster housing 27 is removed from the inner member 10*b* by disengagement of the threads 26. Thereafter, the first and second cluster members 34, 35 may be disengaged from one another by disengaging the "t" member 31 from within the slot 32. The first cluster member 34 then is positioned such that the end 34*a* of the member 34 is faced downwardly and positioned at the uppermost end of the passage 35*a* within the top of the second cluster member 35. A slot or groove 38 within the second cluster member 35 receives the "t" 31 and the o-ring 30 is now within the passage 35*a*. However, in this position, the o-ring 30 does not form an effective piston area, because of the provision of the large piston area "c" defined across the upper end of the second cluster member 35 by means of the circumferentially extending elastomeric seal element 37 which is sealingly engaged around the cylinder bore 39*c*.

A monitored fluid flow passage 29 is defined within the second cluster member 35 below the lowermost end of the first cluster member 34 and below the o-ring 30 to permit fluid communication to the lowermost face of the second cluster member 35 and actuation of pressure upon the piston area "c". In this position, the end 33 of the first cluster member 34 will contact and engage the lowermost face of the spool 17 to cause movement of such spool either upwardly, in the event of an increase in the monitored fluid pressure, or downwardly, in the event of a reduction in the pre-determined level of such fluid pressure.

In the event that a third of a selected number of predetermined levels of monitored fluid pressure is desired to actuate the pressure switch assembly 100, the cluster members 34 and 35 are arranged in the cluster housing 27, as shown in FIG. 2. In such instance, the first cluster member 34 is placed within the passage 35*a* such that the o-ring seal element 30 is within the passage 35*a* and the "t" member 31 of the member 24 is within the slot 32. In this configuration, as shown in FIG. 2, the intermediate level of pressure has been selected as the designated level of pressure for actuation of the pressure switch assembly 100, and effective piston area "b" defined as the area across the elastomeric o-ring seal element 36 detects the level of the monitored fluid pressure and the piston area "b" will extend from the interior of the cylinder bore 39*b* thereacross.

OPERATION

In order to operate the pressure switch assembly 100, the selected bias force for movement of the spool 17 in one direction is determined by picking the appropriate spring member 14 and placing same within the body 10*b*. A micro-switch 21 is threadedly secured into the inner member 10*b* at threads 20 such that contact 21*a* biases the rod actuator 22 inwardly upon engagement with the outer tip 22*c*.

Assuming that the intermediate pressure level of the sourced fluid pressure is desired for actuation of the pressure switch assembly 100, the cluster of members 34 and 35 is arranged as in FIG. 2. If the lower or higher of the pressure ratings is desired, the clusters 34, 35 may be configured as shown in FIG. 3 or FIG. 4.

Upon selection of the appropriate cluster configuration, the members 34 and 35 are arranged within the cluster housing 27 and the housing 27 is secured to the inner member 10*b* by manipulation of the threads 26, with the pressure switch assembly 100 either being secured to a source of fluid pressure at threads 40*a* or, alternatively, a fluid pressure conduit 24 is inserted by means of threads 40 in the cluster housing 27.

Assuming that an increase in sourced fluid pressure is the force which causes the pressure switch assembly 100 to manipulate the micro-switch 21, the level of pressure will be detected across effective piston area "b" and spool 17 will be moved upwardly, with atmospheric pressure being vented through vent port 28. Now, the mating surface 17*e* along the spool 17 will shift the inner tip 22 laterally until the bias through contact 21*a* is overcome and the contact 21*a* engages the end of either a positive or negative element in the micro-switch 21, in conventional fashion. The micro-switch 21, in turn, causes activation of an audible and/or visible signal indicating the existence of the predetermined pressure level or, alternatively, actuates an auxiliary device, such as a secondary valve, or the like.

It will be appreciated that the fluid contemplated for use with the pilot 100 may either be a liquid or a gas. It will be further appreciated that the micro-switch 21 may be either a true electric switch, or may be a fiber-optic element, laser, or the like. In any event, by utilization of the phrase "micro-switch" in this specification and claims, any type of device which is activated by electric or light or optic signal source is contemplated.

It will be further appreciated that the biasing member 14 need not be a spring, but may, in fact, be another source, or level, of the sourced fluid, or some other fluid, either in liquid or gaseous format.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A pressure switch assembly activatable by monitored fluid pressure, comprising:
(1) a body having a central cylindrical chamber;
(2) a reduced diameter bore communicating with one end of said central chamber;
(3) a spool disposed in said reduced diameter bore;
(4) a bore defined in said body transverse of said spool and communicating with said reduced diameter bore for receipt therethrough of:
(5) a rod actuator having a profiled inner tip extending interiorly of the reduced diameter bore, and an outer tip for contact With a micro-switch to selectively open and close a signal, circuit in response to a sensed pressure level in said pressure switch assembly;
(6) a mating surface disposed on said spool companionly contoured relative to the profiled inner tip of said rod actuator;
(7) first means in said central cylindrical chamber for applying a bias against one end of said spool equal to a predetermined pressure level sensed by said pressure switch assembly; and
(8) second means in said pressure switch assembly in communication with a source of fluid pressure for overcoming the bias of said first means in response to a pressure level detected by said pressure switch in variation of said pre-determined fluid pressure level to manipulate said spool in a first direction and shift said rod actuator to one position to open or close said circuit.

2. The pressure switch assembly of claim 1 wherein said profiled inner tip of said rod actuator is arrow-shaped and the mating surface on said spool defines a groove for receipt of said rod actuator inner tip, said groove being circumferentially subscribed around said spool and having one end defining a first diameter slopingly extending to the other end having a second enlarged diameter, said rod actuator when said inner tip is disposed at one end of said groove opening said circuit, said rod actuator when said inner tip is disposed at the other end of said groove closing said circuit.

3. The pressure switch assembly of claim 1 wherein the mating surface on said spool defines a groove for receipt of said rod actuator inner tip, said groove being circumferentially subscribed around said spool and having one end defining a first diameter slopingly extending to the other end having a second enlarged diameter, said rod actuator, when said inner tip is disposed at one end of said groove, opening said circuit, said rod actuator, when said inner tip is disposed at the other end of said groove, closing said circuit.

4. The method of actuating a micro-switch in response to a monitored fluid pressure through a pressure switch assembly, comprising the steps of:
(a) providing a pressure switch assembly, comprising:
(1) a body having a central cylindrical chamber;
(2) a reduced diameter bore communicating with one end of said central chamber;
(3) a spool disposed in said reduced diameter bore;
(4) a bore defined in said body transverse of said spool and communicating with said reduced diameter bore for receipt therethrough of:
(5) a rod actuator having a profiled inner tip extending interiorly of the reduced diameter bore, and an outer tip for contact with a micro-switch to selectively open and close a signal circuit in response to a sensed pressure level in said pressure switch assembly;
(6) a mating surface disposed on said spool companionly contoured relative to the profiled inner tip of said rod actuator;
(7) first means in said central cylindrical chamber for applying a bias against one end of said spool equal to a predetermined pressure level sensed by said pressure switch assembly; and
(8) second means in said pressure switch assembly in communication with a source of fluid pressure for overcoming the bias of said first means in response to a pressure level detected by said pressure switch assembly in variation of said predetermined fluid pressure level to manipulate said spool in a first direction and shift said rod actuator to one position to open or close said circuit; and
(b) varying the fluid pressure level and manipulating said spool in a first direction to shift said rod actuator to one position to open or close said circuit.

5. A pressure switch assembly actuatable by a monitored fluid pressure, comprising:
(1) a body having a central cylindrical chamber;
(2) a reduced diameter bore communicating with one end of said central chamber;
(3) a spool disposed in said reduced diameter bore;
(4) first means in said central cylindrical chamber for applying a bias against a first end of said spool equal to a pre-determined pressure level sensed by said pressure switch
(5) a piston chamber disposed in said body in communication with said reduced diameter bore;

(6) a cluster of piston members for shifting of said spool in a first direction, each of said piston members defining a face having a separate effective piston area thereacross corresponding to a respective pre-determined pressure rating of said monitored fluid and selectively arrangable within said body to permit only one of said pre-determined pressure ratings of said monitored fluid to act on said cluster and shift said spool valve in a first direction.

6. The pressure switch assembly of claim 5 wherein first and second piston members form said cluster of piston members and said piston members define a low, an intermediate, and a high effective piston area, one of said cluster members forming two of said low, intermediate and high effective piston areas thereacross.

7. The pressure switch assembly of claim 5 wherein a piston chamber, housing is provided for receipt of said cluster of piston chamber, said piston member housing being selectively engagable with and removable from said body for manual realignment of said cluster piston members.

8. The pressure switch assembly of claim 5 wherein said first and second piston members form said cluster, said second piston member being housed within said first piston member, said first piston member having first and second piston areas thereacross, said second piston member having a third piston area thereacross.

9. The pressure switch assembly of claim 8 wherein said first member defines a piston member chamber therein and an opening at each end for selective receipt of said second piston member.

10. The pressure switch assembly of claim 9 further including: a slot disposed around one end of said first piston member and a "T" neck defined on said second piston member for mating receipt with said slot.

11. The pressure switch assembly of claim 9 further comprising: a groove for receipt of an end of said second piston member, said end of said second piston member profiled for snug receipt within said end of said first piston

12. The pressure switch assembly of claim 8 further comprising second piston member having first and second ends, one of said ends of said second piston member having means for locking engagement within an end of the first piston member the other of said first and second ends of id piston member providing sealing means for sealing engagement relative to said piston member chamber.

13. A pressure switch assembly activatable by monitored fluid pressure, comprising:

(1) a body having a central cylindrical chamber;

(2) a reduced diameter bore communicating with one end of said central chamber;

(3) a spool disposed in said reduced diameter bore;

(4) a bore defined in said body transverse of said spool and communicating with said reduced diameter bore for receipt therethrough of:

(5) a rod actuator having a profiled inner tip extending interiorly of the reduced diameter bore, and an outer tip for contact with a micro-switch to selectively open and close a signal circuit in response to a sensed pressure level in said pressure switch assembly;

(6) a mating surface disposed on said spool companionly contoured relative to the profiled inner tip of said rod actuator;

(7) first means in said central cylindrical chamber for applying a bias against one end of said spool equal to a predetermined pressure level sensed by said pressure switch assembly; and (8) second means in said pressure switch assembly in communication with ; a source of fluid pressure for overcoming the bias of said first means in response to a pressure level detected by said pressure switch assembly in variation of said pre-determined fluid pressure level to manipulate said spool in a first direction and shift said rod actuator to one position to open or close said circuit, said second means in said body for overcoming the bias of said first means comprising: a cluster of piston members for shifting of said spool in a first direction, each member defining a face having a separate effective piston area thereacross corresponding to a respective pre-determined pressure rating of said monitored fluid and selectively arrangable within said body to permit only one of said pre-determined pressure ratings of said monitored fluid to act on said cluster and shift said spool in a first direction.

14. The pressure switch assembly of claim 13 wherein first and second piston members form said cluster of piston members and said piston members defined a low, an intermediate, and a high effective piston area, one of said cluster members forming two of said low, intermediate and high effective piston areas thereacross.

15. The pressure switch assembly of claim 13 wherein a piston chamber housing is provided for receipt of said cluster of piston members, said piston chamber housing being selectively engagable with and removable from said body for manual realignment of said cluster piston members.

16. The pressure switch assembly of claim 13 wherein said first and second piston members, form said cluster, said second piston member being at least partially housed within said first piston member, said first piston member having first and second piston areas thereacross, said second piston member having a third piston area thereacross.

17. The pressure switch assembly of claim 16 wherein said first member defines a piston member chamber therein and an opening at each end for selective receipt of said second piston member.

18. The pressure switch assembly of claim 17 further including: a slot disposed around one end of said first piston member for mating receipt of a "T" neck defined on said second piston member for mating receipt with said slot.

19. The pressure switch assembly of claim 17 further comprising: a groove for companion receipt of an end of said second piston member, said end of said second piston member profiled for snug receipt within said end of said first piston member.

20. The pressure switch assembly of claim 17 wherein said second piston member having first and second ends, one of said first and second ends of said second piston member having means for locking engagement within an end of the first piston member, the other of said first and second ends of said second piston member providing sealing means for sealing engagement relative to said piston member chamber.

* * * * *